US011306937B2

(12) United States Patent
Ko

(10) Patent No.: US 11,306,937 B2
(45) Date of Patent: Apr. 19, 2022

(54) TEMPERATURE DETECTING DEVICE AND AIR CONDITIONER

(71) Applicant: PixArt Imaging Inc., Hsin-Chu (TW)

(72) Inventor: Yi-Hsien Ko, Hsin-Chu (TW)

(73) Assignee: PixArt Imaging Inc., Hsin-Chu (TW)

( * ) Notice: Subject to any disclaimer, the term of this patent is extended or adjusted under 35 U.S.C. 154(b) by 155 days.

(21) Appl. No.: 16/111,217

(22) Filed: Aug. 24, 2018

(65) Prior Publication Data

US 2020/0064006 A1 Feb. 27, 2020

(51) Int. Cl.
*F24F 11/523* (2018.01)
*F24F 11/72* (2018.01)
*F24F 110/10* (2018.01)

(52) U.S. Cl.
CPC ..... *F24F 11/523* (2018.01); *F24F 11/72* (2018.01); *F24F 2110/10* (2018.01)

(58) Field of Classification Search
CPC ..... F24F 11/523; F24F 11/72; F24F 2110/10
USPC ..... 454/258
See application file for complete search history.

(56) References Cited

U.S. PATENT DOCUMENTS 4,729,293 A * 3/1988 Tsunoda ..... F24F 13/1426 454/313
2014/0138043 A1* 5/2014 Matsumoto ..... F24F 11/523 165/11.1
2015/0233598 A1* 8/2015 Shikii ..... G01D 11/30 165/244
2016/0154413 A1* 6/2016 Trivedi ..... F24F 11/62 700/276
2017/0146260 A1* 5/2017 Ribbich ..... F24F 11/30
2017/0227941 A1* 8/2017 Chosokabe ..... H05B 47/19

* cited by examiner

*Primary Examiner* — Allen R. B. Schult
(74) *Attorney, Agent, or Firm* — Winston Hsu

(57) ABSTRACT

A temperature detecting device is cooperated with an air conditioner. The temperature detecting device includes a temperature detector and a visual indicator. The temperature detector is utilized to generate a temperature distribution result about a specific area. The visual indicator is electrically connected to the temperature detector and utilized to provide a visual mark indicating position information according to the temperature distribution result. The conditioner includes an air supply module, a wind adjustment module and a detection camera. The wind adjustment module is adapted to adjust wind's direction from the air supply module. The detection camera is electrically connected with the wind adjustment module and adapted to detect the visual mark for controlling the wind adjustment module.

20 Claims, 10 Drawing Sheets

TEMPERATURE DETECTING DEVICE AND AIR CONDITIONER

BACKGROUND OF THE INVENTION

1. Field of the Invention

The present invention relates to a temperature detecting device and an air conditioner, and more particularly, to a temperature detecting device with a smart image controlling function and a related air conditioner.

2. Description of the Prior Art

A conventional air conditioner may have a temperature sensor (or a biological sensor) disposed on a front panel of the air conditioner and used to detect room temperature. The conventional air conditioner adjusts wind temperature according to a detection result. The room temperature may be increased due to a heat source existed in an indoor space, and the temperature sensor can acquire a direction and a distance of the heat source relative to the air conditioner, so that an air supply module of the conventional air conditioner can cool the heat source accordingly. However, detection scope of the temperature sensor is constrained by position of the conventional air conditioner, and the temperature sensor cannot detect the heat source far from the air conditioner. The drawback of the conventional air conditioner is that each air conditioner is necessary to match with the temperature sensor and a plurality of air conditioners cannot be cooperated to each other. In addition, the temperature sensor may be distant from and communicated with the conventional air conditioner in a remote-controlled manner, and the temperature sensor has a coordinate system different from ones of the conventional air conditioner. The conventional air conditioner has to acquire a relative distance and a relative direction of the temperature sensor; thus, and calibrates indication information detected by the temperature sensor via the relative distance and the relative direction. The conventional air conditioner can analyze the calibrated indication information to acquire correct position of the heat source.

SUMMARY OF THE INVENTION

The present invention provides a temperature detecting device with a smart image controlling function and a related air conditioner for solving above drawbacks.

According to the claimed invention, a temperature detecting device includes a temperature detector and a visual indicator. The temperature detector is utilized to generate a temperature distribution result about a specific area. The visual indicator is electrically connected to the temperature detector and utilized to provide a visual mark indicating position information according to the temperature distribution result. The position information is variable to represent the front, the rear, the left or the right of the temperature detecting device.

The visual mark is provided according to a pixel block with highest temperature inside the temperature distribution result, or a pixel block having a greatest heat sum inside the temperature distribution result, or a pixel block having a heat sum extremely greater than a background heat sum of the temperature distribution result. The temperature detecting device further includes a processor electrically connected with the temperature detector and the visual indicator, and adapted to analyze the temperature distribution result for generation of the visual mark.

According to the claimed invention, an air conditioner includes an air supply module, a wind adjustment module and a detection camera. The wind adjustment module is adapted to adjust wind's direction from the air supply module. The detection camera is electrically connected with the wind adjustment module and adapted to detect a visual mark for controlling the wind adjustment module.

The temperature detecting device of the present invention can be put on anywhere in front of the air conditioner, and generate the visual mark to indicate the direction, the distance and the temperature level of the heat source without transformation of coordinate systems. The air conditioner can capture the image about the visual mark to acquire accurate position of the heat source. If the plural temperature detecting devices exist or each temperature detecting device has the plural visual indicator and the air conditioner detects several visual marks, the visual marks can be individually weighted to determine the accurate position of the heat source. The temperature detecting device provides sufficient position information of the heat source via the visual mark, so that the present invention does not need the distance and the direction of the temperature detecting device relative to the air conditioner.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
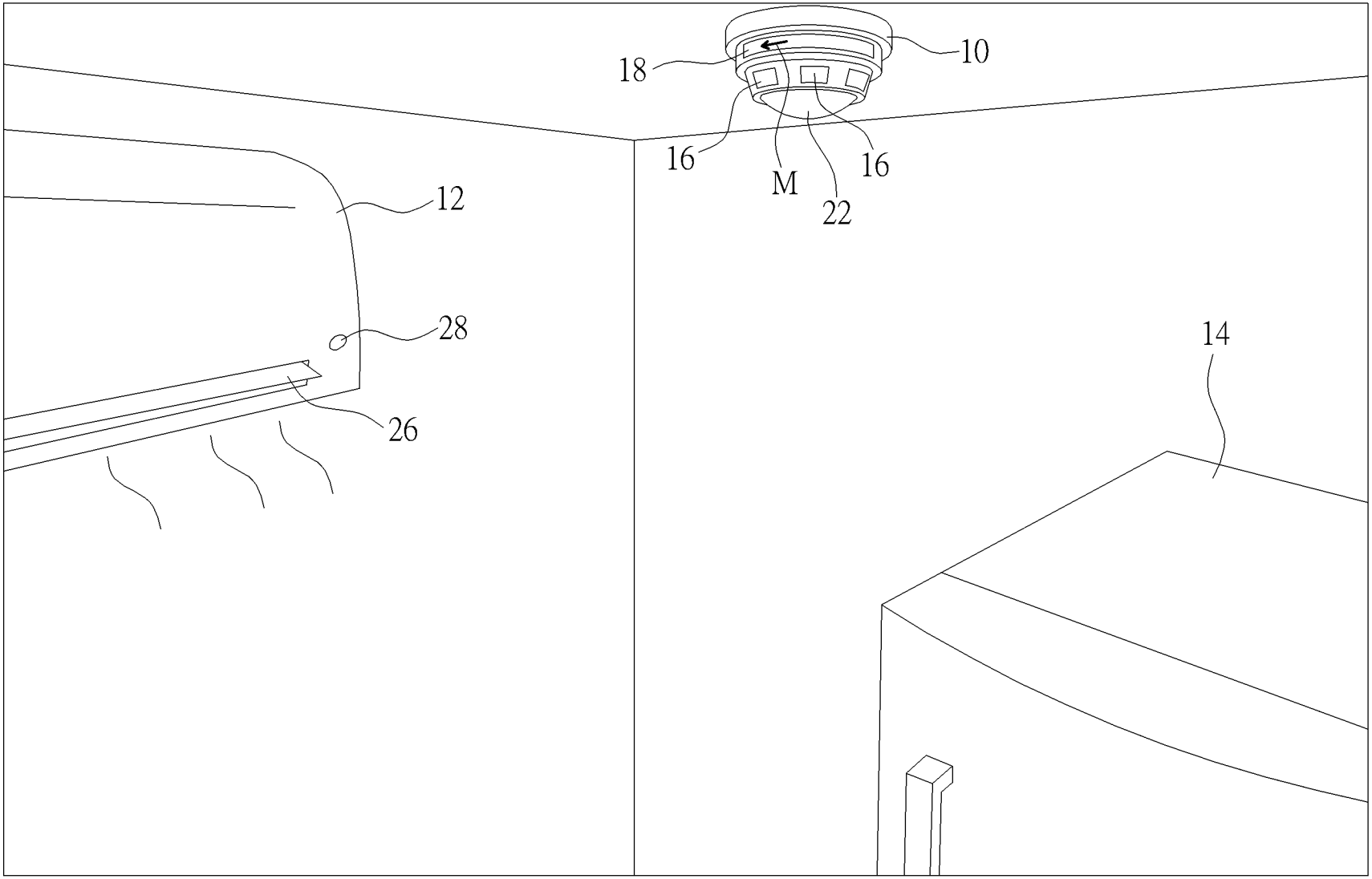
FIG. 1 is a diagram of a temperature detecting device and an air conditioner according to an embodiment of the present invention.
Figure 2:
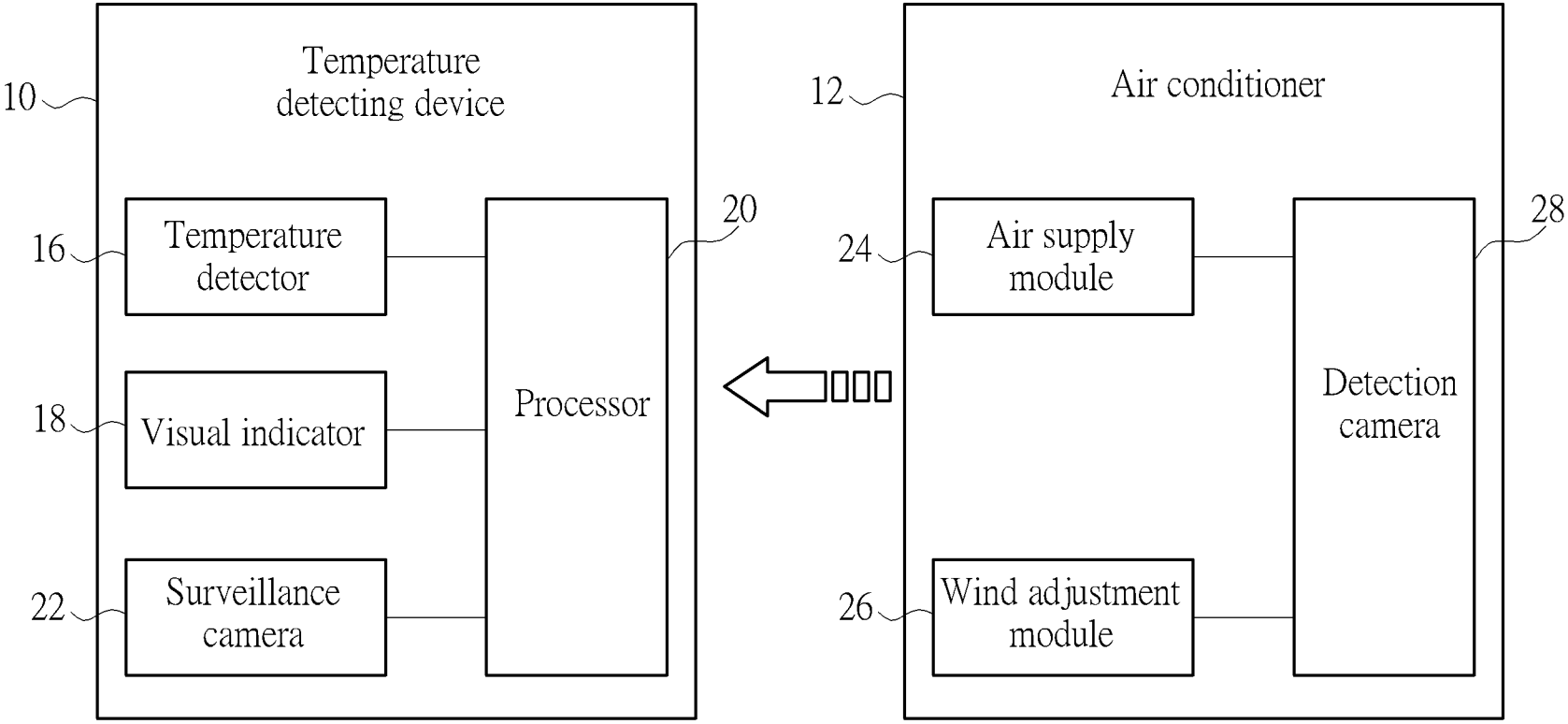
FIG. 2 is a functional block diagram of the temperature detecting device and the air conditioner according to the embodiment of the present invention.
Figure 3:
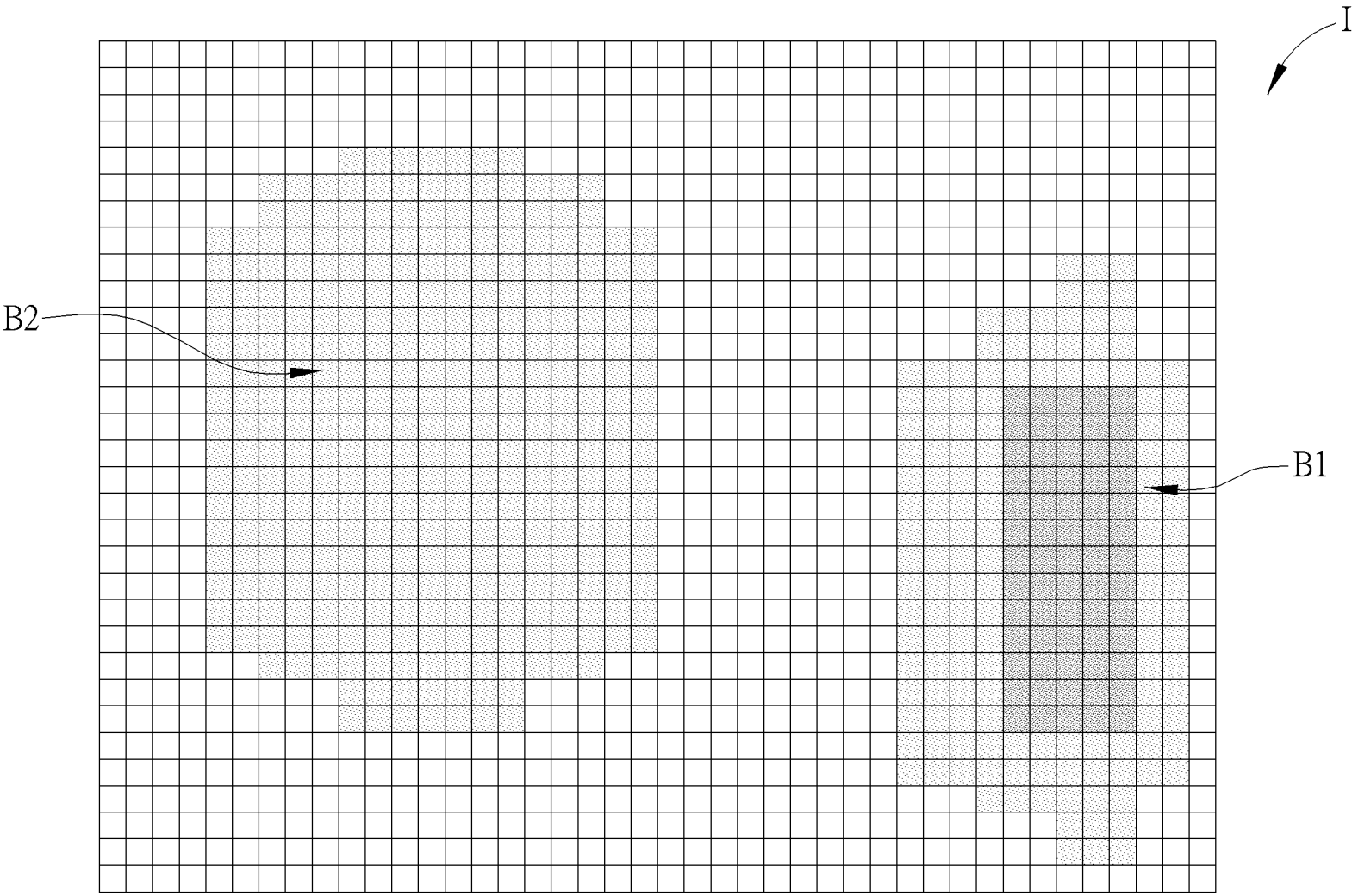
FIG. 3 is a diagram of the temperature distribution result generated by the temperature detecting device according to the embodiment of the present invention.

Please refer to FIG. 1 to FIG. 3. FIG. 1 is a diagram of a temperature detecting device 10 and an air conditioner 12 according to an embodiment of the present invention. FIG. 2 is a functional block diagram of the temperature detecting device 10 and the air conditioner 12 according to the embodiment of the present invention. FIG. 3 is a diagram of a temperature distribution result according to the embodiment of the present invention. The temperature detecting device 10 can be used to detect ambient temperature or its variation, where the ambient temperature may be generated by a heat source 14, such as a stove, a refrigerator or a dehumidifier. The temperature detecting device 10 can be installed on the ceiling or the wall and send out a detection result when the ambient temperature or its variation conforms to a predetermined condition. The air conditioner 12 can be used to capture a detection image about the temperature detecting device 10. The detection image is analyzed to acquire indication of the heat source 14 and therefore the air conditioner 12 can adjust the ambient temperature accordingly.

The temperature detecting device 10 can include a temperature detector 16, a visual indicator 18 and a processor 20 electrically connected to each other. The temperature detector 16 can be utilized to generate the temperature distribution result about a specific area where the temperature detecting device 10 and the air conditioner 12 are positioned. The temperature detector 16 could include a 2D sensor array or formed by an array of sensors, as long as the detected temperature distribution result can be a two-dimensional temperature distribution pattern I, as shown in FIG. 3. The visual indicator 18 can be utilized to provide a visual mark M according to the temperature distribution result, and the visual mark M can indicate position information about a heat source 14 that induces temperature which matches a specific condition, such as the temperature rises over a threshold, having the heist temperature, or having the largest difference compared to a background temperature.

The air conditioner 12 can capture a detection image containing a pattern of the visual mark M so as to acquire the position information. The visual indicator 18 can be a display panel, a plurality of lighting units (such as light emitting diodes, LED) or any possible electric equipment. The processor 20 can be an internal electric unit of the temperature detecting device 10 and may be integrated with or independent of the visual indicator 18. The processor 20 further can be an external electric unit electrically connected with the temperature detector 16 and the visual indicator 18.

In one embodiment, when the processor 20 analyzes the temperature distribution result and finds out an unusual rise in temperature, one or several sensors of the sensor array which corresponds to the unusual rise can represent coordinates of the heat source 14 inside the specific area, and the visual mark M is generated to indicate the position information of the heat source 14. The position information is variable and can point out that the heat source is positioned at a relative position around the temperature detecting device 10, such as right below, in the front, the rear, the left or the right of the temperature detecting device 10. Due to the sensor array of the temperature detector 16, the two-dimensional temperature distribution pattern I can be formed by pixel blocks. Sizes of each pixel block can be any parameter, such as square array or rectangular array, which depend on design demand. The processor 20 can analyze the pixel blocks of the temperature distribution pattern I and drive the visual indicator 18 to provide the visual mark M via analysis result.

For example, a pixel block B1 with highest temperature can be represented as a location of the heat source 14 inside the specific area, and a pixel block B2 with lower temperature can be represented as an unimportant object, so the visual mark M can be generated to indicate a distance and a direction of the heat source 14 relative to the temperature detecting device 10. The dense pattern can represent the high temperature and the sparse pattern can represent the low temperature. In addition, heat detected by plural pixels of the pixel block B1 and B2 can be added up, and the visual mark M can be generated to indicate the position information of the pixel block B1 belonging to the heat source 14 because the pixel block B1 has a greatest heat sum and the pixel block B2 has the less heat sum. Moreover, if difference between the heat sum of the pixel block B1 and a background heat sum of the temperature distribution pattern I is larger than difference between the heat sum of the pixel block B2 and the background heat sum, the pixel block B1, which has the heat sum extremely greater than the background heat sum, can be used to represent the location of the heat source 14.

In one embodiment, the temperature detecting device 10 further includes a surveillance camera 22. The surveillance camera 22 is electrically connected with the processor 20. The surveillance camera 22 can be used to capture a surveillance image about the specific area. If the heat source 14 inside the specific area is overheated and detected, some pixel blocks inside the temperature distribution pattern I related to the location of the heat source 14 can accordingly show an overheated feature. The overheated feature may be red color or any reminder because a temperature of the heat source 14 exceeds a predefined threshold. The processor 20 can analyze the temperature distribution pattern I to acquire the feature, and then generate an alarm signal (such as an alarm bell) and drive the surveillance camera 22 for transmitting the surveillance image in a wireless manner. The user may use a portable communication apparatus to receive the surveillance image in the wireless manner so as to realize what accident happened when the user does not stay in the specific area.

The air conditioner 12 can include an air supply module 24, a wind adjustment module 26 and a detection camera 28 electrically connected with each other. The wind adjustment module 26 is used to adjust at least one of wind direction, wind velocity, wind quantity and wind temperature generated by the air supply module 24. The detection camera 28 can capture the detection image about the temperature detecting device 10. The detection image contains the visual mark M provided by the visual indicator 18, so that the detection camera 28 can analyze the detection image to acquire the position information of the heat source 14 and accordingly control the wind adjustment module 26, that is to say, a distance and a direction between the temperature detecting device 10 and the air conditioner 12 is unnecessary for the air conditioner 12. As long as the temperature detecting device 10 is positioned in a field of view of the detection camera 28, the air conditioner 12 can capture the detection image about the visual mark M to simply acquire the position information of the heat source 14.

Figure 4:
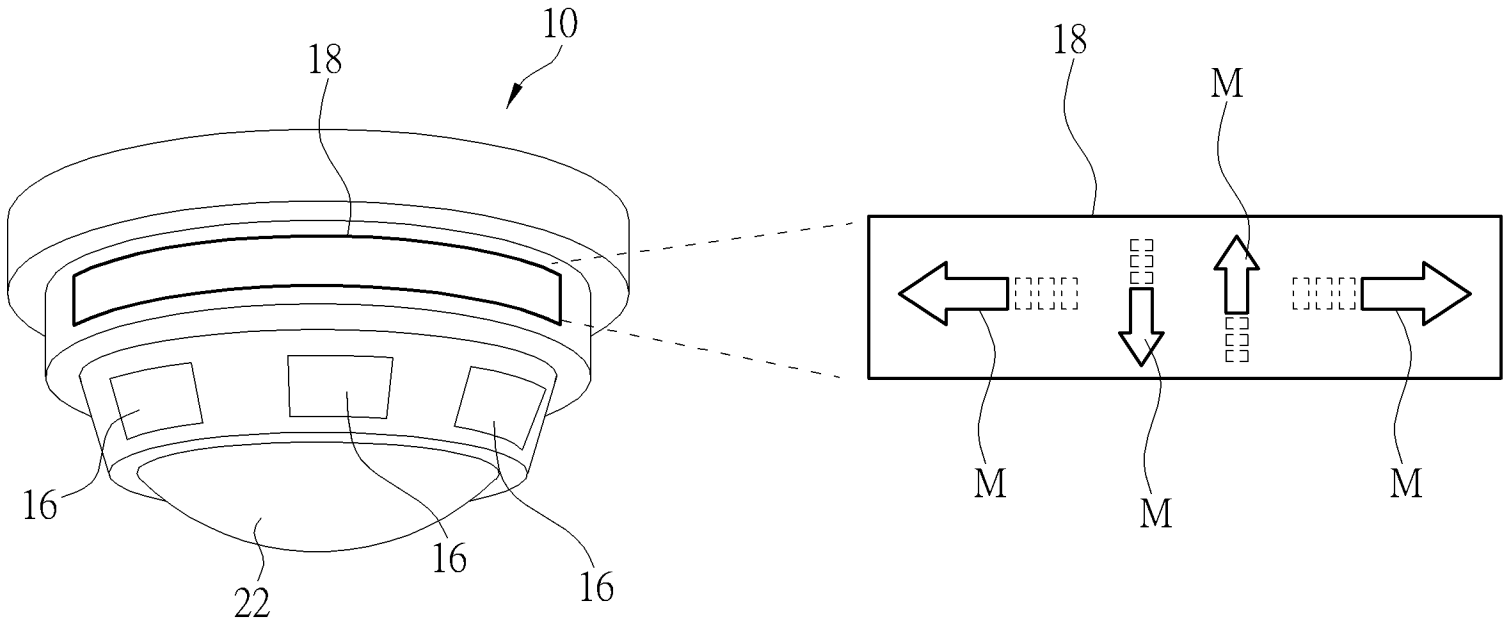
FIG. 4 and FIG. 5 are diagrams of the visual mark according to a first embodiment of the present invention.
Figure 5:
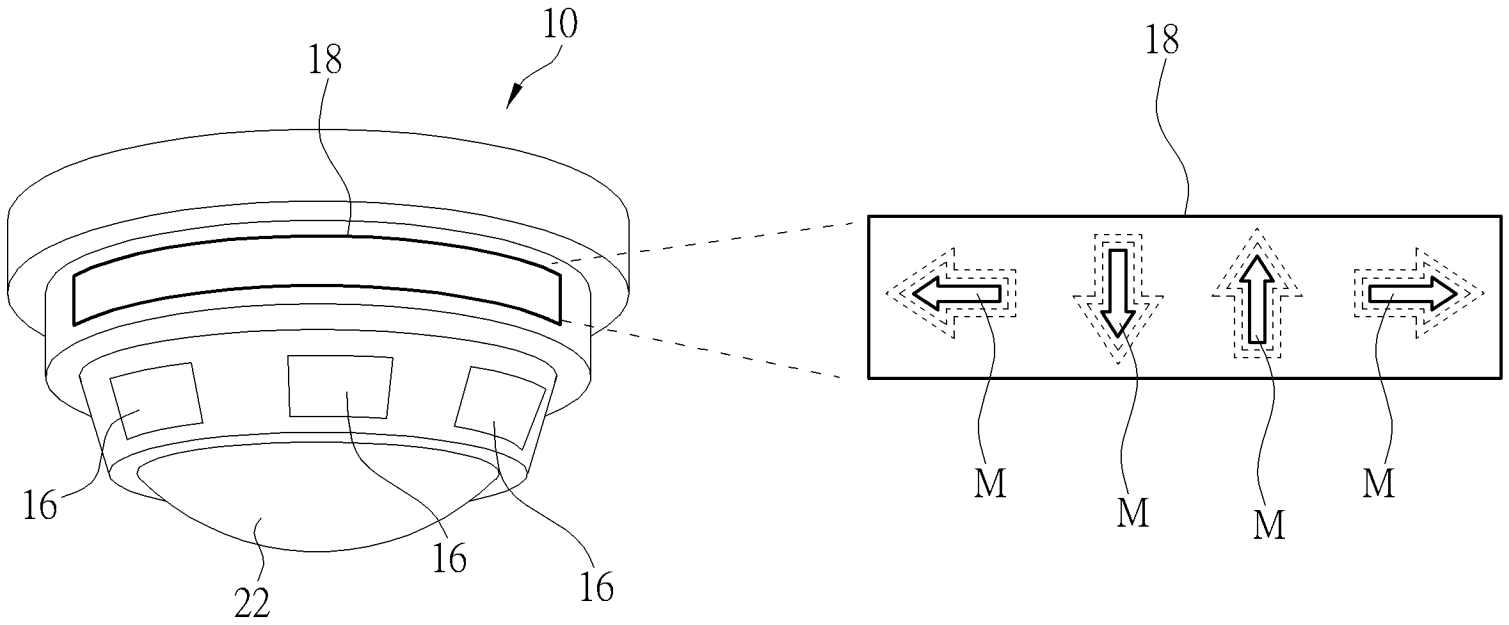

Please refer to FIG. 4 and FIG. 5. FIG. 4 and FIG. 5 are diagrams of the visual mark M according to a first embodiment of the present invention. In the first embodiment, the visual indicator 18 can be the display panel, and the visual mark M can be an arrow icon used to indicate the position information of the heat source 14. The visual indicator 18 may show two or four visual marks M for different directions. A combination of the two visual marks M may respectively point toward the left and the right of the temperature detecting device 10. A combination of the four visual marks M may respectively point toward the upper, the lower, the left and the right of the temperature detecting device 10. The visual mark M may point toward the upper right, the lower right, the upper left and the lower left. The visual mark M can be a triangular icon or a V-shaped icon. Thus, an amount, a shape and an orientation of the visual mark M are not limited to the above-mentioned embodiments, which depend on design demand.

As an example of having the two arrow icons, one arrow icon points toward the left and the other arrow icon points toward the right because the temperature detecting device 10 is installed on the ceiling. If the temperature detecting device 10 is installed on the wall or the floor, four arrow icons can respectively point toward the upper, the lower, the left and the right. In addition, at least one of a length and a width of the visual mark M can be varied to indicate a temperature level or a heating period about the heat source 14. For instance, as shown in FIG. 4, the extended visual mark M (such as the dotted lines) can represent the high temperature or a continuous heating condition, and the shortened visual mark M (such as the solid line) can represent the low temperature or a transient heating condition. As shown in FIG. 5, the huge visual mark M (such as the dotted line) can represent the high temperature or the continuous heating condition, and the small visual mark M (such as the solid line) can represent the low temperature or the transient heating condition.

The third and the fourth arrow icons may be optionally formed between the arrow icons pointing toward the left and the right, as the middle of the visual indicator 18 shown in FIG. 4 and FIG. 5. The visual mark M points toward the underside can be lighted to indicate that the heat source 14 is located on the front of the temperature detecting device 10 so that the heat source 14 can be located between the observer and the temperature detecting device 10. The visual mark M points toward the upside can be lighted to indicate that the heat source 14 is located on the rear of the temperature detecting device 10 so that the temperature detecting device 10 can be located between the heat source 14 and the observer.

In the present invention, the colors and flickering frequency of the arrow icon can be changed to indicate variation of the temperature level or the heating period. The green arrow icon or the static arrow icon may represent the low temperature or the transient heating condition; and the yellow arrow icon or the low speed flickering arrow icon may represent middle temperature or the continuous heating condition; and the red arrow icon or the high speed flickering arrow icon may represent the high temperature or a long-term heating condition. Application of the colors and the flickering frequency is not limited to the above-mentioned embodiments, which depend on design demand.

Figure 6:
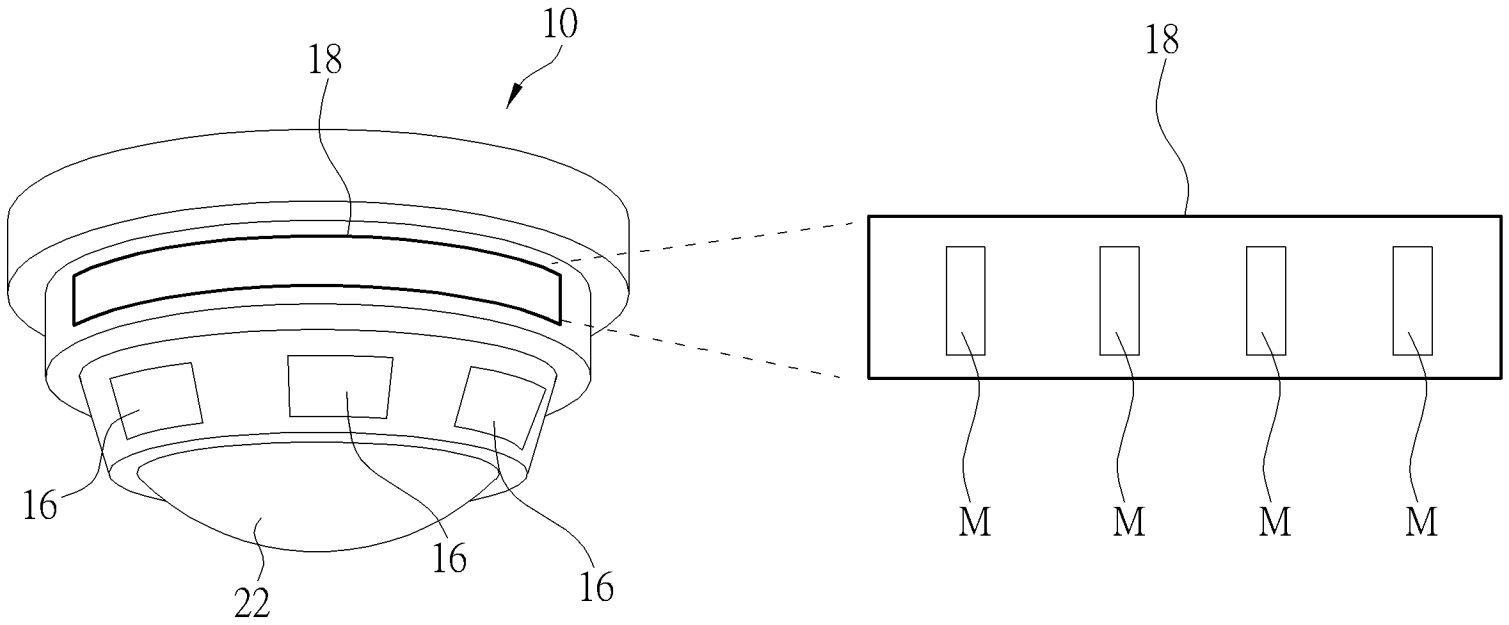
FIG. 6 and FIG. 7 are diagrams of the visual mark according to a second embodiment of the present invention.
Figure 7:
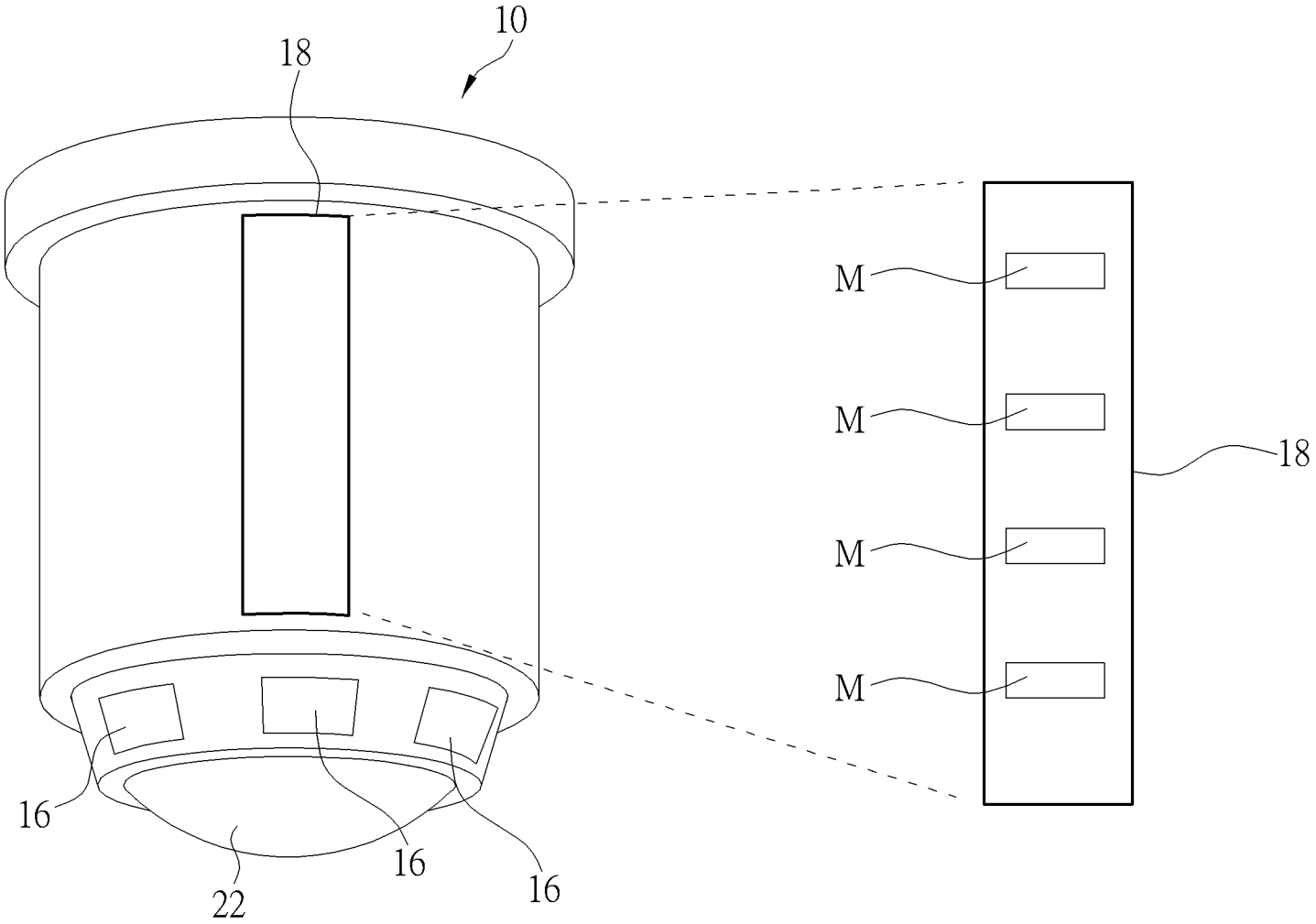

Please refer to FIG. 6 and FIG. 7. FIG. 6 and FIG. 7 are diagrams of the visual mark M according to a second embodiment of the present invention. In the second embodiment, the visual mark M can include an arrangement of several basic icons. The basic icon may be selected from a group consisting of a polygon form, a circular form, a bar form, and a combination thereof. When the visual mark M has four bar basic icons, each of the four bar basic icons can be respectively positioned at a particular position to represent a particular orientation about the heat source 14. As an example shown in FIG. 6 and FIG. 7, the first bar basic icon from the right and the upper may represent the front of the temperature detecting device 10, and the second bar basic icon from the right and the upper may represent the rear of the temperature detecting device 10, and the third bar basic icon from the right and the upper may represent the left of the temperature detecting device 10, and the fourth bar basic icon from the right and the upper may represent the right of the temperature detecting device 10.

As the first embodiment mentioned above, at least one of a length and a width of the visual mark M of the second embodiment can be changed to indicate the temperature level or the heating period. For example, when the room temperature on the left of the temperature detecting device 10 is higher than the room temperature on the right of the temperature detecting device 10, the third basic icon has the length longer than ones of the fourth basic icon; when the heating period on the rear of the temperature detecting device 10 is longer than the heating period on the front of the temperature detecting device 10, the second basic icon has the width larger than ones of the first basic icon. The basic icons can change the colors and the flickering frequency to represent variation of the temperature level or the heating period.

Figure 8:
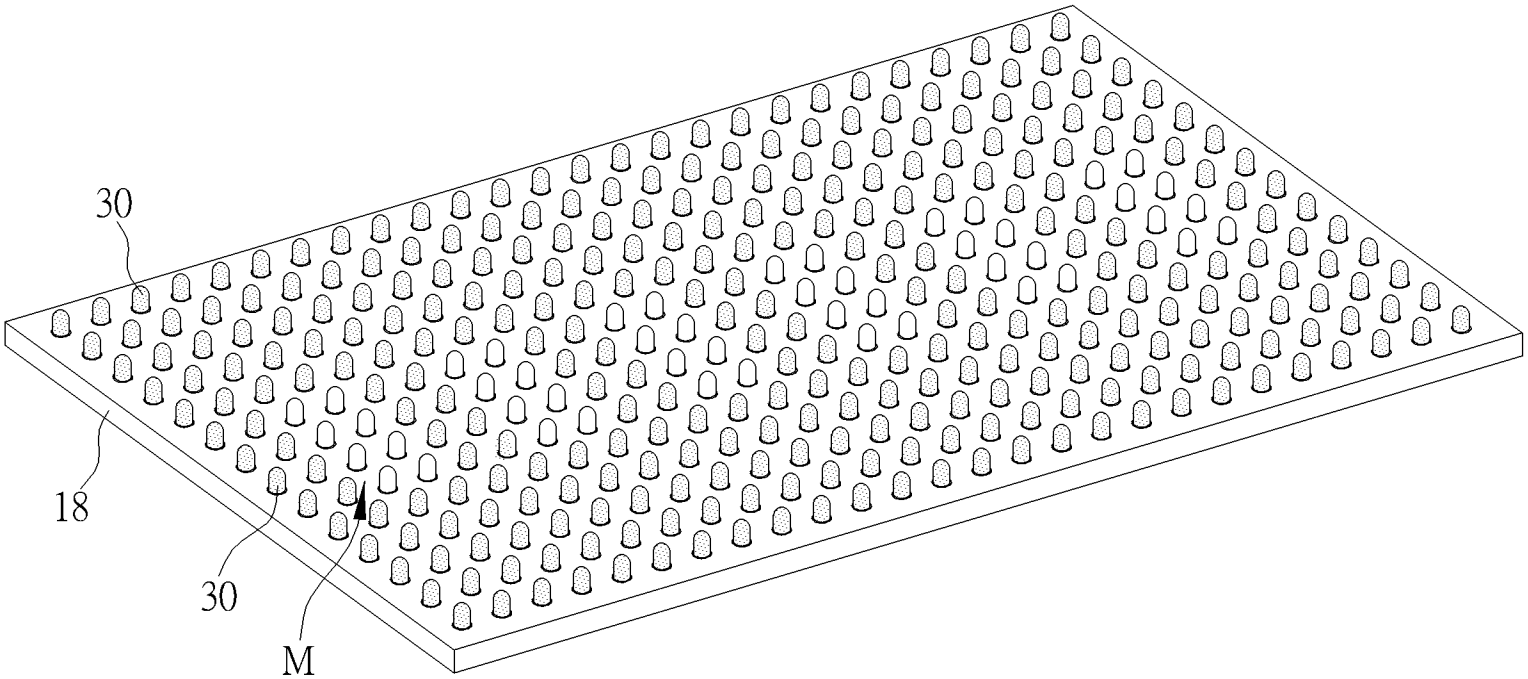
FIG. 8 is a diagram of the visual mark according to a third embodiment of the present invention.

Please refer to FIG. 8. FIG. 8 is a diagram of the visual mark M according to a third embodiment of the present invention. In the third embodiment, the visual indicator 18 can be formed by the plurality of lighting units 30. When the temperature detector 16 detects and generates the temperature distribution result, some of the plurality of lighting units 30 can be turned on to establish the visual mark M. An amount or an arrangement of the turned-on lighting units 30 can be changed to represent the position information of the heat source 14. For example, one lighting unit 30 positioned on a left side of the visual indicator 18 can be turned on to represent that the room temperature on the left of the temperature detecting device 10 is risen, and plural lighting units 30 positioned on the left side of the visual indicator 18 can be turned on to represent the room temperature on the left exceeds the predefined threshold. The lighting units 30 may be divided into some groups and respectively disposed on several specific positions of the visual indicator 18, such as the front, the rear, the left and the right of the visual indicator 18. The detection camera 28 can identify the specific position of the turned-on lighting unit 30 for acquiring the indication of the heat source 14. Besides, the lighting units 30 may have different colors or flickering frequency. The left side of the visual indicator 18 may have three lighting units 30, such as the red LED, the yellow LED and the green LED. The red LED can be turned on in the cold condition, and the yellow LED can be turned on in the warm condition, and the green LED can be turned on in the hot condition. Moreover, the flickering frequency of the chromatic LED can be increased and decreased due to the temperature risen or descended.

In one embodiment, the temperature detecting device 10 can have a background temperature reset function. The processor 20 can be switched into a normal mode or several environmental modes according to the user's demand. In the normal mode, the processor 20 can analyze the temperature distribution result to directly detect abnormal variation of the room temperature; when the temperature of the heat source 14 is suddenly increased or increased over the threshold, the visual indicator 18 can provide the visual mark M for triggering the air condition 12. In the environmental modes, a local violent temperature variation may be acceptable. Each environmental mode has a background temperature data correlated to a particular region inside the temperature distribution result, and the processor 20 can compare the temperature distribution result to the background temperature data for determining whether the particular region is abnormal.

The environmental modes can be a cooking mode, an unoccupied mode, a night mode or a party mode. As an example of the cooking mode, the particular region may represent the kitchen, and the background temperature data correlated to the particular region may be 50° C. People in the kitchen are moved in and out, so that the background temperature data may be adjustable according to a property of the environmental mode. When the temperature of the temperature distribution result is cold and the temperature of the particular region (such as the kitchen) is hot but not over the threshold, the processor 20 can analyze a comparison result between the temperature distribution result and the background temperature data to acquire the feature (someone is working in the kitchen), and the rising temperature distribution result is normal so the processor 20 does not output the alarm signal. When the temperature of the particular region is increased and over the threshold, the processor 20 can acquire the feature (the kitchen is on fire) by analyzing the comparison result, so that the temperature distribution result is abnormal and the processor 20 outputs the alarm signal.

Figure 9:
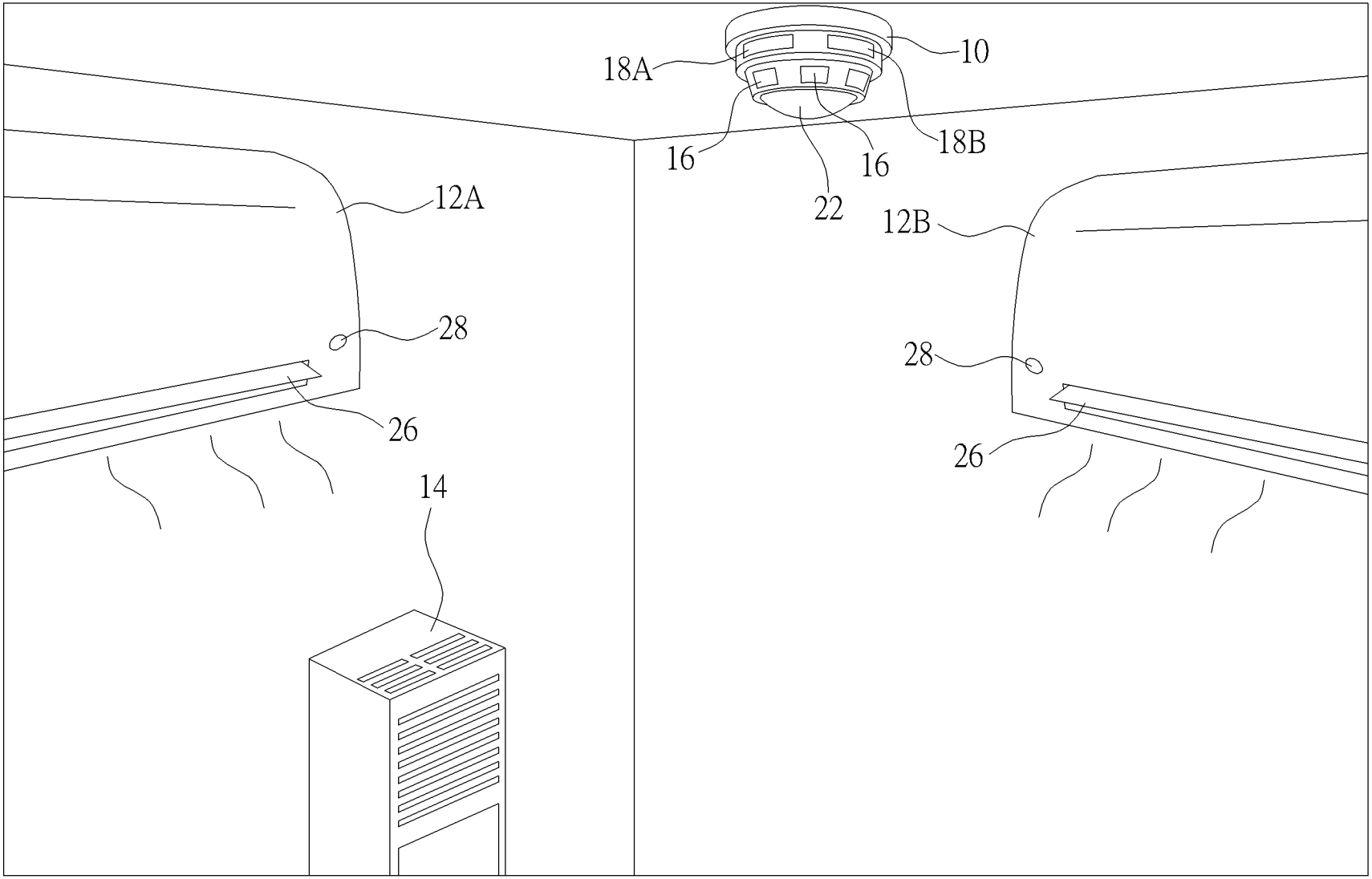
FIG. 9 is a diagram of the temperature detecting device according to other embodiment of the present invention.

In the present invention, the temperature detecting device 10 can be cooperated with a plurality of air conditioners 12. Please refer to FIG. 9. FIG. 9 is a diagram of the temperature detecting device 10 according to other embodiment of the present invention. The temperature detecting device 10 may include a plurality of visual indicators 18A and 18B, and the visual indicators 18A and 18B can surround a main body 32 of the temperature detecting device 10. The main body 32 may be a cylinder or a polyhedron, and the visual indicators 18A and 18B can be respectively disposed on separated or opposite positions of the main body 32 in a non-parallel manner. As the embodiment shown in FIG. 9, the heat source 14 is put between two air conditioners 12A and 12B, the left-side visual indicator 18A can show the visual mark M pointing to the right and the right-side visual indicator 18B can show the visual mark M pointing to the left for indication of the heat source 14. The air conditioner 12A can detect the visual mark M (pointing to the right) and guides the cold airflow toward the heat source 14; and the air conditioner 12B can detect the visual mark M (pointing to the left) so as to guide the cold airflow toward the heat source 14.

Figure 10:
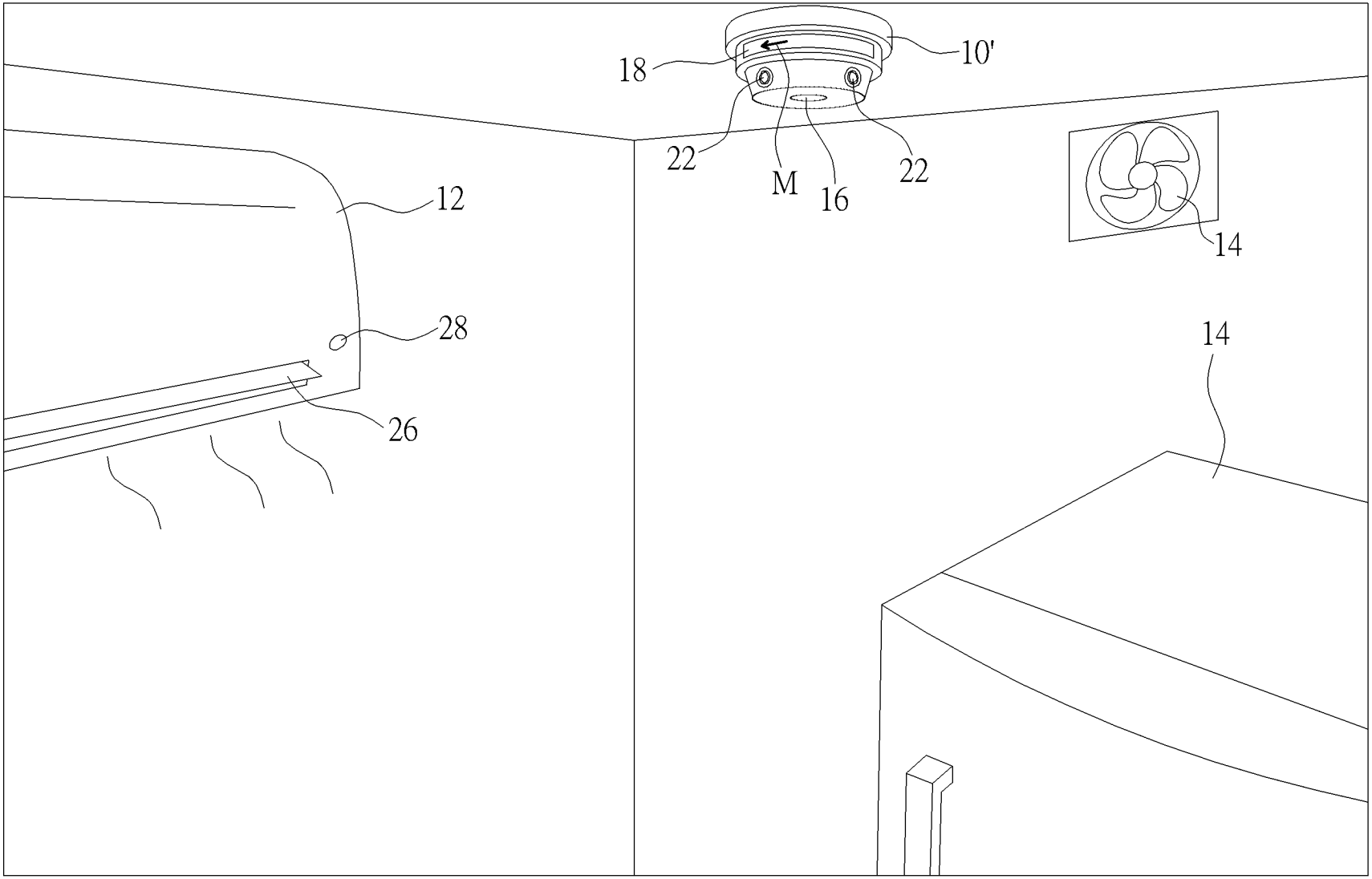
FIG. 10 is a diagram of the temperature detecting device according to other embodiment of the present invention.

Please refer to FIG. 10. FIG. 10 is a diagram of the temperature detecting device 10' according to other embodiment of the present invention. The temperature detecting device 10' may include the temperature detector 16 disposed under the surveillance camera 22, and the surveillance camera 22 can be disposed on a lateral surface of a main body of the temperature detecting device 10'. Position of the surveillance camera 22 may be changed according to a purpose of the temperature detecting device 10'. If the temperature detecting device 10' is used to detect the heat source 14 close to the roof, such as the air conditioner or an exhaust fan, the surveillance camera 22 may face the right and/or the left of the temperature detecting device 10' for acquiring the surveillance image containing the related heat source 14. In addition, the visual indicator 18 may be optionally disposed under the temperature detector 16 or surveillance camera 22, which depends on design demand.

The temperature detecting device of the present invention can be put on anywhere in front of the air conditioner, and generate the visual mark to indicate the direction, the distance and the temperature level of the heat source without transformation of coordinate systems. The air conditioner can capture the image about the visual mark to acquire accurate position of the heat source. If the plural temperature detecting devices exist or each temperature detecting device has the plural visual indicator and the air conditioner detects several visual marks, the visual marks can be individually weighted to determine the accurate position of the heat source. Comparing to the prior art, the temperature detecting device provides sufficient position information of the heat source via the visual mark, so that the present invention does not need the distance and the direction of the temperature detecting device relative to the air conditioner.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. An air conditioning system comprising:

an air conditioner comprising a detection camera and a controller electrically connected to the detection camera;

a temperature detecting device separate from the air conditioner, comprising:

a temperature detector utilized to generate a temperature distribution result of the specific area; and a visual indicator electrically connected to the temperature detector and disposed on an outside surface of the temperature detector and adapted to be directional guidance for providing a plurality of visual marks respectively indicating different position information of at least one heat source and being detected by the detection camera of the air conditioner;

wherein the plurality of visual marks comprises directions pointing toward a left side and toward a right side of the temperature detecting device to indicate position relation between the at least one heat source and the air conditioner, and one of the plurality of visual marks is enabled to emit light according to the temperature distribution result;

wherein the detection camera is configured to detect the plurality of visual marks on the visual indicator such that the controller controls the air conditioner based upon the detected visual marks.

2. The air conditioning system of claim 1, wherein the position information is variable to further represent a front side and a rear side of the temperature detecting device.

3. The air conditioning system of claim 1, wherein the visual mark is provided according to a pixel block with a highest temperature inside the temperature distribution result, or a pixel block having a greatest heat sum inside the temperature distribution result, or a pixel block having a heat sum greater than a background heat sum of the temperature distribution result, wherein the pixel block is part of the temperature distribution result processed by the temperature detector.

4. The air conditioning system of claim 1, wherein the temperature detecting device further comprises:

a processor electrically connected with the temperature detector and the visual indicator, and adapted to analyze the temperature distribution result for generation of the plurality of visual marks.

5. The air conditioning system of claim 1, wherein the visual indicator has a plurality of lighting units, the visual indicator turns on some of the plurality of lighting units to establish the plurality of visual marks in accordance with the temperature distribution result.

6. The air conditioning system of claim 1, wherein the temperature distribution result is a two-dimensional temperature distribution pattern.

7. The air conditioning system of claim 4, wherein the processor analyzes and acquires a feature of the temperature distribution result, and then generates an alarm signal when the feature is greater than a predefined threshold.

8. The air conditioning system of claim 7, wherein the temperature detecting device further comprises:

a surveillance camera electrically connected with the processor and utilized to output a surveillance image when the alarm signal is generated.

9. The air conditioning system of claim 5, wherein the plurality of lighting units is respectively displayed by different specific colors.

10. The air conditioning system of claim 5, wherein the plurality of lighting units is respectively actuated by different flickering frequency.

11. The air conditioning system of claim 1, wherein the plurality of visual marks are arrow icons used to indicate the position information.

12. The air conditioning system of claim 11, wherein at least one of a length and a width of the arrow icons is used to indicate a temperature level related to the temperature distribution result.

13. The air conditioning system of claim 11, wherein at least one of a length and a width of the arrow icons is used to indicate a heating period related to the temperature distribution result.

14. The air conditioning system of claim 1, wherein the plurality of visual marks comprises an arrangement of several basic icons, each of the basic icons positioned at a particular position represents a particular orientation of the position information.

15. The air conditioning system of claim 14, wherein at least one of a length and a width of each basic icon represents a temperature level related to the temperature distribution result.

16. The air conditioning system of claim 14, wherein at least one of a length and a width of each basic icon represents a heating period related to the temperature distribution result.

17. The air conditioning system of claim 14, wherein the basic icons are selected from a group consisting of a polygon form, a circular form, a bar form, and combination thereof.

18. The air conditioning system of claim 4, wherein the processor has at least one environmental mode with a background temperature data, and the processor determines whether the temperature distribution result is over a threshold of the background temperature data by comparing the temperature distribution result to the background temperature data.

19. The air conditioning system of claim 18, wherein the background temperature data is correlated with a particular region inside the temperature distribution result.

20. The air conditioning system of claim 18, wherein the background temperature data is adjustable in accordance with a property of the environmental mode.

* * * * *